US011185871B2

(12) United States Patent
Hermansen et al.

(10) Patent No.: US 11,185,871 B2
(45) Date of Patent: Nov. 30, 2021

(54) ELECTROSTATIC PRECIPITATOR SYSTEM HAVING A GRID FOR COLLECTION OF PARTICLES

(71) Applicant: exodraft A/S, Langeskov (DK)

(72) Inventors: Peter Hermansen, Langeskov (DK); Seyednezamaddin Azizaddini, Langeskov (DK); Per Holm Hansen, Langeskov (DK)

(73) Assignee: exodraft A/S, Langeskov (DK)

( * ) Notice: Subject to any disclaimer, the term of this patent is extended or adjusted under 35 U.S.C. 154(b) by 457 days.

(21) Appl. No.: 16/207,526

(22) Filed: Dec. 3, 2018

(65) Prior Publication Data

US 2019/0168236 A1 Jun. 6, 2019

(30) Foreign Application Priority Data

Dec. 4, 2017 (EP) ..... 17205185

(51) Int. Cl.
*B03C 3/49* (2006.01)
*B03C 3/06* (2006.01)
(Continued)

(52) U.S. Cl.
CPC ..... *B03C 3/49* (2013.01); *B03C 3/06* (2013.01); *B03C 3/41* (2013.01); *B03C 3/47* (2013.01);
(Continued)

(58) Field of Classification Search
CPC combination set(s) only.
See application file for complete search history.

(56) References Cited

U.S. PATENT DOCUMENTS 1,132,124 A * 3/1915 Roberts et al. ..... B03C 3/47 96/98
1,931,436 A * 10/1933 Deutsch ..... B03C 3/36 96/64
(Continued)

FOREIGN PATENT DOCUMENTS

CA 2801786 A1 * 12/2011 ..... B03C 3/08
DE 31 17 124 A1 11/1982
(Continued)

*Primary Examiner* — Christopher P Jones
*Assistant Examiner* — Sonji Turner
(74) *Attorney, Agent, or Firm* — Knobbe Martens Olson & Bear LLP

(57) ABSTRACT

The present invention relates to an electrostatic precipitator (ESP) system (1) for removal of particles from a flue gas flowing in a flow passage (4) being delimited by a primary collection in the form of a collection plate (5). The system comprises a discharge electrode (11) arranged in the flow passage and connected to a high voltage generator (12) providing for an electric field around the discharge electrode. The system further has a secondary collection electrode in the form of a grid (101) arranged within the collection plate and made of an electrically conductive material. The presence of such a grid improves the efficiency of the precipitator. In some embodiments, the ESP system comprises an actuator (112) for moving the grid upwards and letting it drop onto an internal bottom structure (109). The movement between the collection plate and the grid as well as the impact force imparted to the dropping grid both result in a removal of collected particles.

14 Claims, 7 Drawing Sheets

(51) Int. Cl.

| | |
|---|---|
| ***B03C 3/76*** | (2006.01) |
| ***B03C 3/66*** | (2006.01) |
| ***B03C 3/47*** | (2006.01) |
| ***B03C 3/74*** | (2006.01) |
| ***B03C 3/41*** | (2006.01) |

(52) U.S. Cl.
CPC ..... *B03C 3/66* (2013.01); *B03C 3/743* (2013.01); *B03C 3/76* (2013.01); *B03C 3/761* (2013.01); *B03C 3/768* (2013.01); *B03C 2201/04* (2013.01)

(56) References Cited

U.S. PATENT DOCUMENTS

| | | | | | |
|---|---|---|---|---|---|
| 2,142,128 | A * | 1/1939 | Friedrich | B03C 3/12 | 95/79 |
| 3,157,479 | A * | 11/1964 | Boles | F01N 3/01 | 96/82 |
| 6,221,136 | B1 * | 4/2001 | Liu | F01N 3/02 | 96/66 |
| 8,337,600 | B2 * | 12/2012 | Paur | B03C 3/86 | 96/58 |
| 8,894,745 | B2 * | 11/2014 | Dunn | B03C 3/47 | 95/70 |
| 9,132,383 | B2 * | 9/2015 | Ursem | A01K 29/00 | |
| 2001/0020417 | A1 | 9/2001 | Liu et al. | | |
| 2008/0250930 | A1 | 10/2008 | Bologa et al. | | |
| 2011/0011265 | A1 | 1/2011 | Paur et al. | | |
| 2011/0195002 | A1 | 8/2011 | Miller et al. | | |

FOREIGN PATENT DOCUMENTS

| | | | | |
|---|---|---|---|---|
| DE | 101 24 871 | C1 | 10/2002 | |
| DE | 10245902 | A1 * | 4/2004 | B03C 3/74 |
| EP | 0 433 152 | A1 | 6/1991 | |
| EP | 2 244 834 | A1 | 11/2010 | |
| GB | 1 589 025 | | 5/1981 | |

* cited by examiner

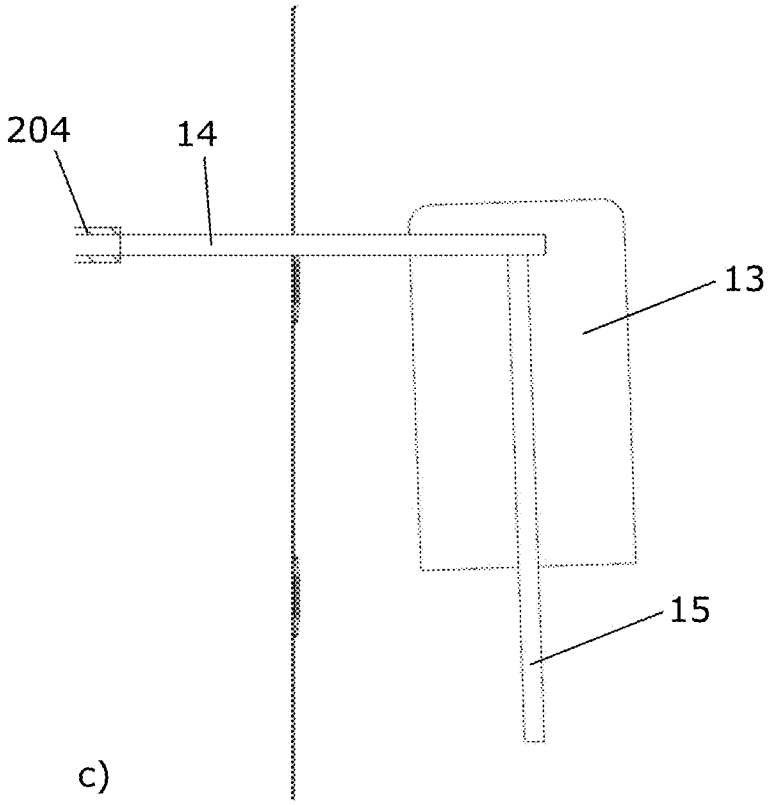
Fig. 1, cont.

ELECTROSTATIC PRECIPITATOR SYSTEM HAVING A GRID FOR COLLECTION OF PARTICLES

FIELD OF THE INVENTION

The present invention relates to electrostatic precipitator systems, and in particular to such systems having means for improved removal of the ultrafine particles present in flue gas from e.g. wood combustion stoves.

BACKGROUND OF THE INVENTION

Wood is an important raw material that contains energy and grows by absorbing $CO_2$ from the air, solar energy and water. Furthermore, wood is $CO_2$ neutral as it absorbs as much $CO_2$ when it grows as it emits when it is burned or decaying in nature. Wood is thus renewable energy and an important source of energy, and it should therefore be burned off e.g. to provide heating of residential houses.

However, a disadvantage of wood combustion is the formation of ultrafine particles of which the vast majority are in the range of 0.01 μm (10 nanometres) to 0.4 μm (400 nanometres). Ultrafine particles are harmful to human beings, because they are not filtered out by the nose and bronchioles and instead enter deep into the lungs from where they can be absorbed directly into the blood stream. This is known to cause a number of adverse health effects.

Particle matter emissions from wood stoves consist of three main types of particles: condensable organic compounds (COC), elemental carbon (soot), and inorganic compounds (ash). These three types have very different resistivities. Particle resistivity plays an important role in the charging and precipitation of the particles by an electrostatic precipitator (ESP); see below. These particles are dry solid particles. Some of the emissions are initially gaseous, but they convert to solid particles as the temperature in the aerosol drops, enabling them to be precipitated.

A known method of reducing the number of fine and ultrafine particles in an aerosol or a flow of flue gas is the use of an electrostatic precipitator (ESP), wherein an electric field causes the aerosol or flue gas around the discharge electrode to become ionized. Hereby either free electrons or charged gas molecules become trapped on the particles and thereby charge the particles.

The charged particles are repulsed from the discharge electrode towards a grounded collection electrode on which they settle and build up. This causes two other problems. First, the thicker the layer of precipitated particles become, the harder it is for the collection electrode to hold on to the particles and prevent them from re-entering the airstream; this is referred to as re-entrainment. Second, the thicker the layer of particles become, the more it can cause a pressure drop in filters that rely on the aerosol or flue gas passing through the collection electrode like a filter. The build-up of particles therefore reduces the efficiency of the ESP over time.

Some ESP systems, as e.g. described in US2001/020417 and EP 2 244 834 B1, rely on droplets such as oil and grease or added water to carry the solid particles away from the collection electrode to prevent build-up and clogging of the filter. This can instead create problems with disposing the particle-containing water/grease/oil.

Among the industrial solutions are also scrubbers that rely on water spray to remove the particles from the collection electrode. This causes additional issues with disposing of the particle-laden liquids.

In large-scale ESPs, it is also known to apply rapping for intentional detachment of the collected particles from both collection electrodes and discharge electrodes. Rappers are devices that cause a forceful impact force to be applied to the electrodes, such as the collection electrode, such that the particles collected thereon are broken apart and fall off the collection electrode; this is described e.g. in DE 10124871 C1 and DE 3117124 A1.

Some medium-scale ESPs on the market are equipped with automatic cleaning systems e.g. in the form of spiral brushes or plates that rotate or slide up and down to clean the dust from the collection electrode. For small-scale ESPs installed in a relatively small chimney, such cleaning systems may take up too much space and may have a weight causing undesired forces to be applied to the chimney.

Similar solutions for small-scale ESPs suitable for residential houses are known, e.g. from EP0433152A1, which include a small hammer that applies a knocking force to the inner pipe in the ESP system. This has been tested by the inventor of present system showing that the efficiency is very low because the mechanical inertia distribution to the complete collection electrode is very low and therefore will not stop the particle layer in growing on the collection electrode.

Most of the present ESP devices on the market for dry (non-droplet) particle precipitation for small heating appliances do not have a cleaning system, despite the fact that the precipitation efficiency drops when the particles accumulate on the collection electrode inside the ESP. The ESPs therefore need to be cleaned regularly. Some manufacturers of ESPs for wood-burning stoves and similar heating appliances recommend manual cleaning once or twice a year by e.g. chimneysweepers, but studies made in relation to the present invention have shown that more regular cleaning results in a stable functionality of the ESP; i.e. prevents drop in the precipitation efficiency. Thus, regular cleaning improves the performance of the ESP significantly.

OBJECT OF THE INVENTION

It is an object of the present invention to provide an ESP system having a more efficient removal of ultrafine particles from flue gas flowing through a flow passage of the system than with known systems.

It is another object of the present invention to provide an ESP system wherein a larger amount of particles in the flue gas can be collected by the precipitator between each cleaning thereof than with known systems.

It is another object of the present invention to provide an ESP system with which the cleaning can be performed automatically; i.e. as a self-cleaning system.

It is another object of the present invention to provide an ESP system having a continuously efficient removal of ultrafine particles from flue gas flowing through a flow passage of the system than with known systems.

It is a further object of the present invention to provide an alternative to the prior art.

In particular, it may be seen as an object of the present invention to provide an ESP system that solves the above-mentioned problems of the prior art.

SUMMARY OF THE INVENTION

Thus, the above-described object and several other objects are intended to be obtained by providing an electrostatic precipitator system for dry particle precipitation comprising:

a flue gas inlet for receiving a flow of flue gas, a flue gas outlet for venting the flow of flue gas, a flow passage extending between the flue gas inlet and the flue gas outlet, part of the flow passage being delimited by a primary collection electrode in the form of a collection plate, a discharge electrode connected to a high voltage generator providing for an electric field being generated around the discharge electrode, when the high voltage generator is turned on, the discharge electrode being arranged inside the part of the flow passage being delimited by the collection plate, and a secondary collection electrode in the form of a grid being arranged within the collection plate, the grid comprising a mesh-like structure, such as a mesh or a plate with holes, the mesh-like structure of the grid being made of an electrically conductive material, and the grid being dimensioned, shaped and arranged such that it extends along and at a distance from the collection plate.

In an ESP system according to the invention, the collection plate—i.e. the primary collection electrode—and the grid—i.e. the secondary collection electrode—together form the collection electrode. In the following, "collection plate" is used to refer to the primary collection electrode as the plate delimiting the flow passage, "grid" is used to refer to the secondary collection electrode, and "collection electrode"—i.e. without reference to "primary" or "secondary"—is used to refer to the combination of the collection plate and the grid when describing their combined function as an electrode.

Here and in the following, "connected" does not necessarily mean that the two respective components touch each other. The connection may be established via other components, and the connection will typically be either mechanical or electrical. Examples of the different connections will be described in relation to the figures.

Studies made during the development of the present invention have shown that the arranging of a secondary collection electrode in the form of a grid within the collection plate improves the efficiency of the electrostatic precipitator (ESP) significantly compared to similar known systems wherein the charged particles in the flue gas are collected only on a single collection electrode, e.g. in the form of a plate, without such a secondary collection electrode, such as a grid as in the present invention. This increased efficiency is related to the presence of the secondary collection electrode in the form of the grid causing a reduction in the strength of the field at the primary collection electrode enough to lower the risk of re-entrainment of the precipitated particles. It is also related to the fact that the particles are collected both on the grid and on the collection plate giving a larger surface area of collection.

From observations made during the development of the present invention, it was found that particles are precipitated on the collection plate and on the grid. In the presence of wires forming the grid, the thickness of the dust layer—i.e. the collected particles—on the collection plate can grow up to the wires (typically 2-3 mm) before being interfered/detached by the main stream or the crossing flow also referred to a ion wind. Therefore, it seems that the wires increase the stability of the collected particles on the collection plate so that more particles can be collected.

Furthermore, the mesh-like structure of the grid has been found to improve the function of the collection electrode because it assists in both the precipitation and the burn off of the particles. Studies leading to the present invention have shown that the relatively smaller particle collection area of the grid as compared to a solid surface, such as a plate, can give rise to optimal conditions for burning, and thereby removal, of the particles. These conditions are a function of temperature, oxygen content, and the amount of burnable material (i.e. the collected particles). It has proven possible to optimize these conditions by use of an appropriate design of both the grid and the discharge electrode for a given application, such as for a given type and size of an ESP. By such optimization, the efficiency of the ESP can be improved by removing some of the collected particles by burning whereby more particles can be removed from the aerosol or flue gas before other means of cleaning of the collection electrode becomes necessary. An example of a presently preferred design will be described in relation to the figures. These studies have shown that the grid in combination with a discharge electrode to be described in the following results in self-ignition of the collected particles and correspondingly in self-cleaning of the ESP. It has been observed that the primary sparks are heading toward the grid wires. These sparks provide local high temperature zones that can ignite and burn off the particles on the collection electrode. This burn off process preferably takes place at least once in each combustion cycle of the wood combustion stove at a specific temperature, flue gas oxygen level and thickness of the layer of collected particles. This self-cleaning effect is thus related to the presence of the grid both in embodiments where it is stationary and in embodiments with a movable grid as will be described below.

The grid may be made from the same material as the collection plate which can be made of low or medium carbon steel. It may be advantageous to use stainless steel or alloy steel to obtain a higher corrosion resistance. Corrosion resistance is desirable both due to the flue gas and particle properties and due to the sparks which occur due to the high voltage electric field.

By the grid being arranged "within the collection plate" is preferably meant that it is arranged in the part of the flow passage being delimited by the collection plate. The grid may extend along the full length of the flow passage delimited by the collection plate, or it may extend along a part of the length only. In presently preferred embodiments of the invention, the grid is shaped and dimensioned to cover the whole area where the electric field is strong enough to hold the particles on the collection plate. The particles may be collected on a section about 50-100 mm beyond the length of the discharge electrode at both the top and bottom ends of the flow passage. Therefore, if the grid covers a corresponding area, the precipitation efficiency as well as the cleaning efficiency is higher. However, other relative sizes of the grid and the collection plate are also covered by the scope of the claims.

In some embodiments of the invention, the collection plate comprises a flat shape, which further extends into a curved shape to form a tubular cylinder segment. Such a shape will be useful for some special designs of the electrostatic precipitator system having the high voltage generator arranged in a neighbouring and matching tubular cylinder segment to give a total appearance of a chimney system with a cylindrical circumference as will be described in further details in relation to the figures.

As explained above, the grid may comprise a corrosion-resistant material. It may e.g. be mesh made of corrosion-resistant material through the thickness. It may also be made from another material having an outer coating of corrosion resistant material.

The mesh-like structure of the grid may comprise openings with a vertical dimension of 15-30 mm, such as 18-25 mm, such as 20-22 mm, and a horizontal dimension of 15-30 mm, such as 18-25 mm, such as 20-22 mm. The vertical and horizontal dimensions may be the same or different. By "vertical" and "horizontal", reference is made to the system when installed on a chimney, typically extending from a wood combustion stove. This typically means that the inlet is facing downwards and the outlet is facing upwards.

Two types of wire mesh used for the grid have been tested during the development of the present invention: a mesh having a wire thickness of 2 mm and openings of 20×20 mm; and a mesh having a wire thickness of 1.5 mm and openings of 21×21 mm. Both grids worked satisfactory for the actual overall dimensions of the system tested. The actual size to use for a given electrostatic precipitator system will depend on a number of parameters and possible further characteristics of the system.

In some embodiments of the invention, the electrostatic precipitator system further comprises an actuator for providing a force to the grid so as to move the grid relative to the collection plate, when the actuator is in operation. By such relative movement, some of the collected particles will be mechanically removed as they detach from the layer remaining on the primary collection electrode leaving a layer of remaining particles no thicker than the distance between the collection plate and the grid. The actuator may comprise an electric motor forming part of the electrostatic precipitator system. Such an actuator may e.g. be the one to be described below. It may also be an actuator in the form of a chain or a belt used to apply the movement to the grid. Alternatively or in combination therewith, the system may comprise an actuator which applies a knocking force to the grid in order to release the particles from the grid.

The force provided by the actuator may be an upwards force so as to move the grid upwards, when the actuator is in operation, so that the grid, after being moved upwards, drops from a height due to gravity resulting in the grid impacting on an internal bottom structure of the electrostatic precipitator system. By "internal bottom structure" is meant something onto which the grid can drop so that the downwards movement is stopped fast enough to apply the impact that will cause at least a majority of the particles to fall off the grid in order to provide the cleaning. The upwards movement can be provided by a pushing force or a pulling force.

The mechanical movements of the grid relative to the collection plate initially result in detachment of some of the precipitated particles on the collection plate as described above. When the grid drops on the internal bottom structure, such as a base of the collection plate, the particles are detached from the grid due to the impact and fall down the chimney from where they burn or can be removed. By "internal bottom structure" is meant something onto which the grid can drop so that the downwards movement is stopped fast enough to apply the impact that will cause at least a majority of the particles to fall off the grid in order to provide the cleaning.

In embodiments of the invention having a grid which is moveable by an actuator comprising a motor, the design of the grid is related to the power of the motor used. The limits are the weight the stability of the grid. If the mesh size is fine and/or the wires are thick, the grid may become so heavy that it cannot be lifted by the motor without overloading it. If the mesh size is too big and/or the wires are too thin, the mechanical strength may become so low that the grid cannot withstand the movement and impact forces without being deformed or damaged.

The grid may be resting on the internal bottom structure of the electrostatic precipitator system when not being moved upwards.

In some embodiments of the invention, the grid, when being moved upwards, is moved upwards a distance at least equal to, but preferably larger than, the vertical dimension of the openings in the grid. This has been found to result in a more efficient removal of the particles than with smaller movements, since hereby the relative movement between the grid and collection plate is over the whole surface area of the collection plate causing detachment of particles.

An electrostatic precipitator system having an actuator for providing the vertical movement of the grid as described above may further comprise a control system, which controls when the actuator is in operation and for how long, such that the actuator, when in operation, runs for a period of time during which the grid is moved. Preferably, this cleaning process is activated automatically by the control system, but it may also be activated manually.

In some embodiments of the invention, to ensure a safe and efficient use of an ESP system comprising an actuator, the actuator should only be activated either when there is no hot flue gas flowing through the ESP, with the high voltage generator switched off, or if there is hot flue gas with the high voltage generator switched on. If the ESP system comprises means for applying a forced draft through the chimney, the main power to this system could be switched on. Depending on user preferences and operating schedule, the control system may activate the actuator as soon as the mentioned conditions are achieved. Alternatively, the control system may be programmed to activate the actuator at a predetermined time of the day or upon activation, such as before each time a wood combustion stove to which the system is related is to be used. In presently preferred embodiments of the invention, the actuator is running for 3 to 30 seconds resulting in the upwards force being applied to the grid between 5 and 50 times each resulting in an upward movement and drop of the grid.

The grid may comprise a contacting means which extends from the grid, the grid being moved upwards by the contacting means on the grid making contact with a cam being rotated by a motor, when the actuator is in operation. Such a cam, when seen along the axis of rotation, may have a shape that is generally rectangular with two rounded corners, the rounded corners being opposite each other in both directions, such that the slope of the rounded corners extend to a sharp edge. An example of such a design will be given in relation to the detailed description of the figures.

In some embodiments of the ESP system as described above, the discharge electrode comprises:

- a discharge electrode connector, which is connected to the high voltage generator, and
- a first and a second wire connectors, which are connected to and separated a distance apart by a support rod, the first and second wire connectors having at least one wire suspended between them, and
- the discharge electrode connector, the first and second wire connectors, the support rod, and the at least one wire are all made of electrically conductive material.

Even though the words "support rod" and "wire connector" may give the impression that these parts are merely performing a holding function, that is not the case. They constitute important functional parts of the discharge electrode as they contribute to the desired electric field.

When the discharge electrode is connected to the high voltage generator via the discharge electrode connector, an electric field can be generated around the support rod, the wire connectors and the one or more wires. By changing the shape of the wire connectors, the position of the support rod, and the number and positions of the wires suspended there between, the shape of the resultant electric field can be altered to suit the requirements of a system in which the discharge electrode is to be used. It is thus an advantage of embodiments of the invention having such a discharge electrode that the resultant electric field generated around the discharge electrode can be shaped to suit the needs of a given setup.

The first and second wire connectors being "separated a distance apart" means that there is space in-between them so that they are not in direct contact except via the support rod and the wires. The support rod helps to ensure stability along the length of the electrode and keeps the at least one wire suspended.

By at least one wire being "suspended" between the first and second wire connectors is preferably meant that the at least one wire is somehow attached to and kept in position by the first and second wire connector. Thus, the at least one wire extends from the first to the second wire connector.

The discharge electrode as just described may comprise a plurality of wires, and a first end of the support rod may be mounted within a central region of the first wire connector and a second end of the support rod may be mounted within a central region of the second wire connector such that the plurality of wires are arranged around the support rod.

By the support rod being "mounted within a central region" of the first and of the second wire connector is meant any configuration that will allow for a plurality of wires to be arranged around the support rod. This will allow for an expanded electrical potential distribution due to the location of the wires when compared to a discharge electrode without such wires.

In embodiments of the invention having first and second wire connectors, each of the first and second wire connectors may be shaped as disks and may have a shape in the horizontal plane corresponding to that of a horizontal cross-section of the flow passage delimited by the collection plate when viewed in the vertical direction.

By "disk" is meant that one dimension of the wire connector is significantly smaller than the other two dimensions of the wire connector such that the wire connector has a flat shape.

By shaping the first and second wire connectors in this way, the wires may be suspended between the two wire connectors such that, in combination with positioning of the discharge electrode within the flow passage delimited by the collection plate or collection electrode, a uniform electric field extending between the discharge electrode and the collection plate or collection electrode may be achieved. This is obtained by the possibility of having a substantially equal distance between the wires and the collection plate.

Such a configuration, with a uniform electric field extending between the discharge electrode and the collection electrode, will result in a well-distributed corona discharge across the space between the collection electrode and the discharge electrode; i.e. over the cross section of the flue gas passage. Besides, the wires as a source of the corona discharge are located with an even distance from the collection electrode resulting in an almost uniform delivery of electrons and gas ions to the flue gas. Hereby a more uniform collection over the whole inner surface of the collection plate can be obtained.

The different aspects of the present invention as described above may each be combined with any of the other aspects as long as it is physically possible. These and other aspects of the invention will be apparent from and elucidated with reference to the embodiments described hereinafter.

BRIEF DESCRIPTION OF THE FIGURES

The electrostatic precipitator system according to the invention will now be described in more detail with regard to the accompanying figures. The figures show one way of implementing the present invention and is not to be construed as being limiting to other possible embodiments falling within the scope of the attached claim set.

FIG. 1.*a* shows a top view, and FIG. 1.*b* shows a cross-sectional view along section A-A in FIG. 1.*a*. FIG. 1.*c* shows a partial cross-sectional view of the region around the insulator.

DETAILED DESCRIPTION OF PREFERRED EMBODIMENT

Figure 1:
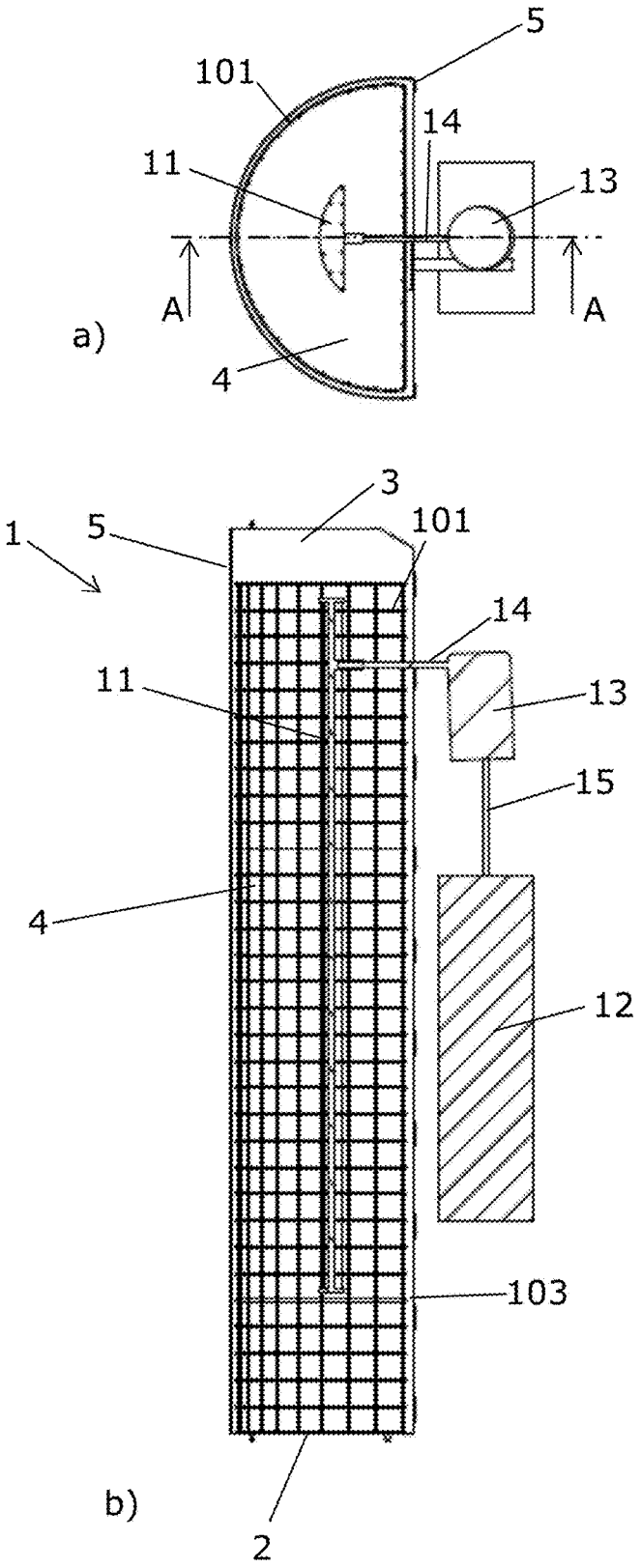
FIG. 1 shows schematically an embodiment of the invention.
Figure 2:
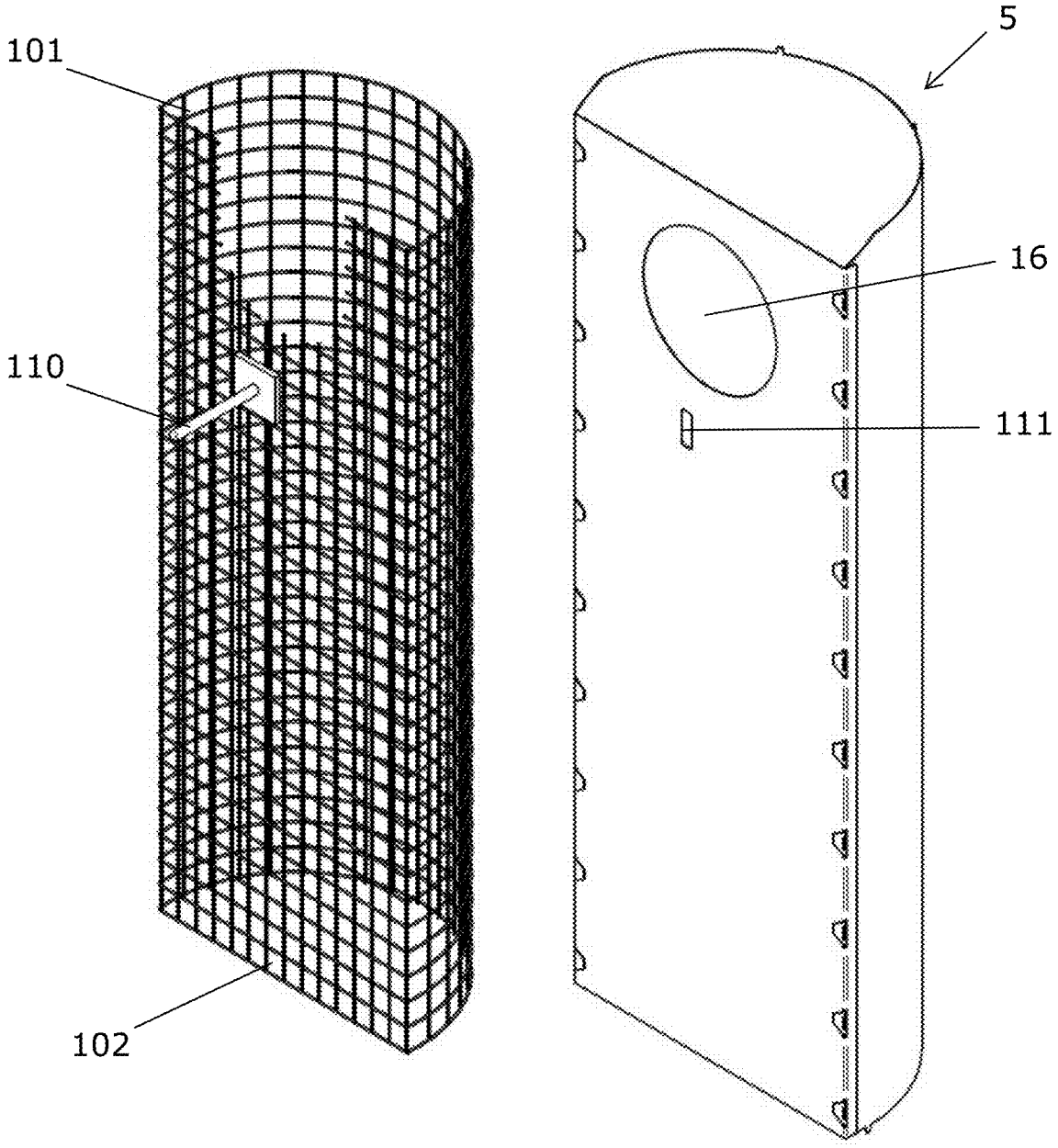
FIG. 2 shows the collection plate and grid of the system in FIG. 1.
Figure 3:
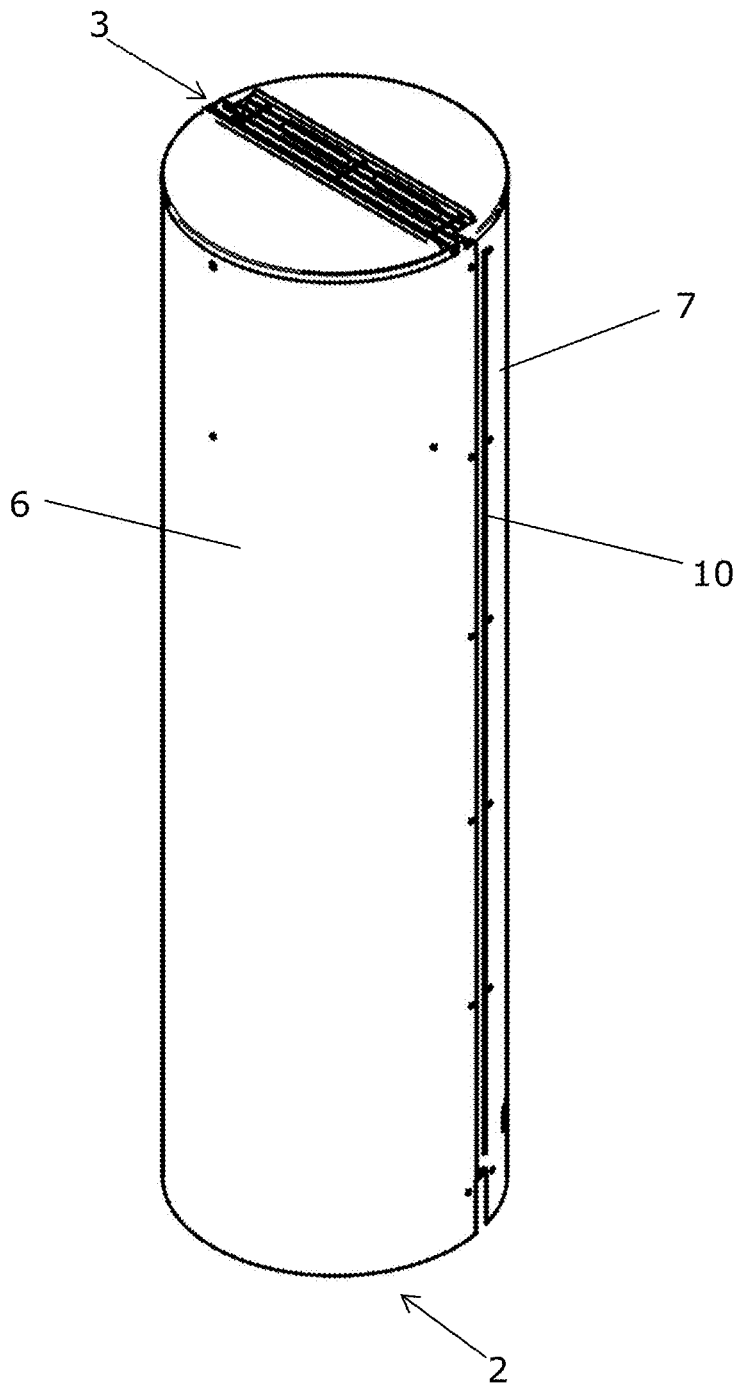
FIG. 3 shows schematically an ESP system having two compartments each being in the form of a tubular cylindrical segment.

FIG. 1 shows schematically an electrostatic precipitator (ESP) system 1 according to the present invention; FIG. 1.*a* shows a top view, and FIG. 1.*b* shows the system in cross-sectional view along line A-A in FIG. 1.*a*. The system 1 is designed to be arranged on a chimney of e.g. a wood combustion stove in order to remove particulate matter from the flue gasses from wood combustion. However, it can also be used for other applications where it is desired to remove particles from a flue gas. The ESP system 1 comprises a flue gas inlet 2 for receiving a flow of flue gas, a flue gas outlet 3 for venting the flow of flue gas, and a flow passage 4 extending between the flue gas inlet 2 and the flue gas outlet 3. At least a part of the flow passage 4 is delimited by a primary collection electrode in the form of a collection plate 5. The ESP system 1 also comprises a secondary collection electrode in the form of a grid 101 arranged within the collection plate 5. The collection plate 5 and the grid 101 in combination form the collection electrode of the ESP system 1. The collection plate 5 and the grid 101 of the system in FIG. 1 are shown arranged next to each other in three-dimensional view in FIG. 2 showing that the collection plate 5 comprises a flat shape which extends into a curved shape to form a tubular cylinder segment. The grid 101 has a corresponding shape. This shape is particularly interesting in an embodiment of the invention as shown in FIG. 3, where parts of the ESP system 1 to be protected from the high temperatures in the flue gas are arranged in a separate second compartment 7 also being of a tubular cylinder segment and forming a protective shielding. The matching first compartment 6 is established either by the collection plate 5 itself, or by an outer housing surrounding the collection plate 5. By suitable dimensioning and arranging the two tubular cylinder segments, it is possible to obtain the overall appearance of a circular cylinder. In the embodiments in FIG. 2 and the following figures, the flat part of the collection plate 5 as well as the flat part of the second compartment 7 and the flat part of the first compartment 6, each comprises a lateral opening 16 providing a passage for the components of the system extending between the first and the second compartments 6,7.

Figure 4:
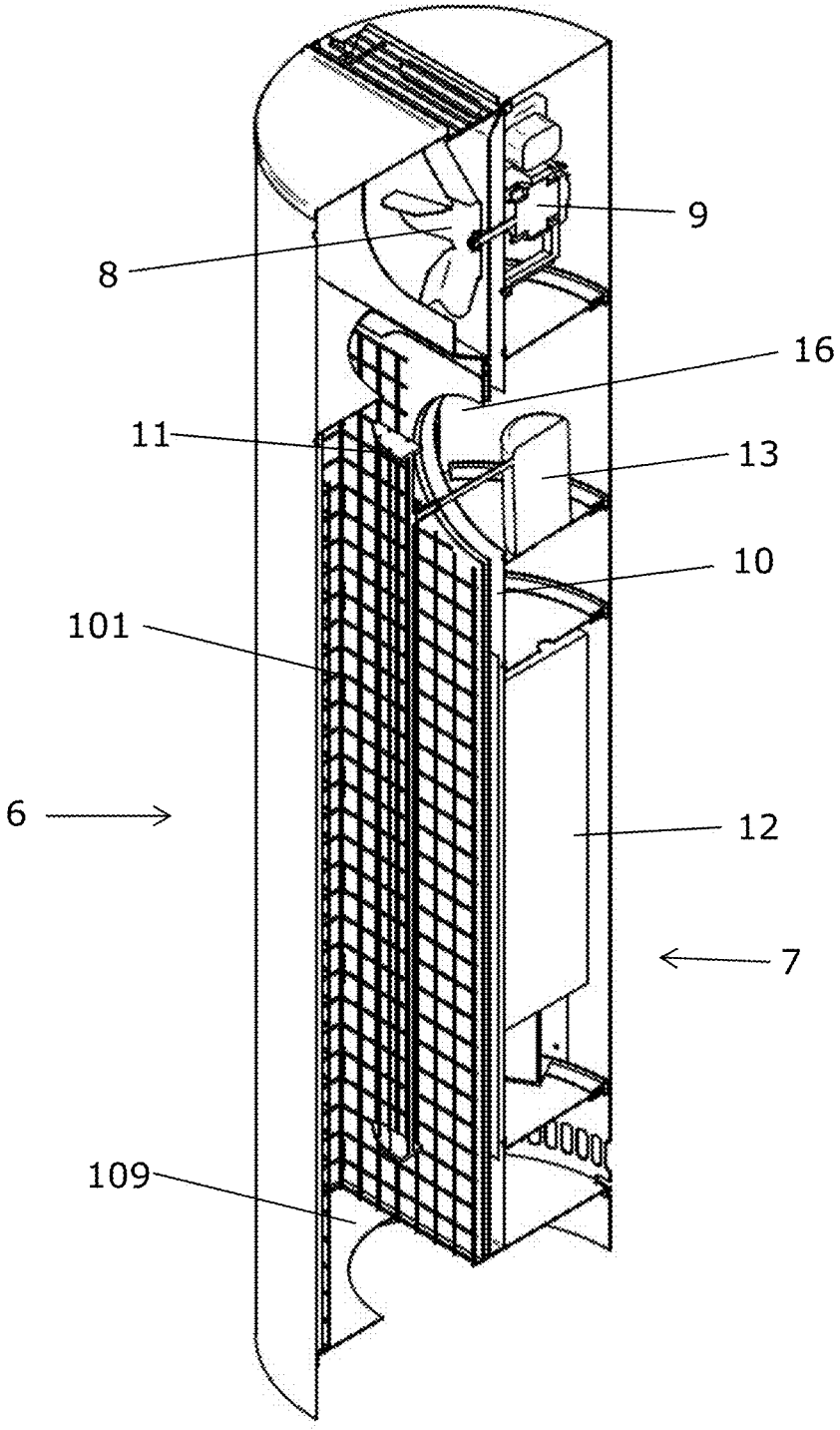
FIG. 4 shows schematically a three-dimensional partial view of an embodiment of the invention.

The ESP system 1 may be of a type having a forced draft obtained by arranging a motor-driven impeller 8 located upstream of the outlet 3; such an embodiment is shown schematically and in cross-sectional partial view in FIG. 4. The motor 9 for driving the impeller 8 can be arranged in the second compartment 7. As shown in FIGS. 3 and 4, there is an air gap 10 between the two compartments to improve the protection of the electric and electronic parts arranged in the second compartment 7 from the hot flue gas.

As shown in FIG. 1, the ESP system 1 further comprises a discharge electrode 11 connected to a high voltage generator 12 providing for an electric field being generated around the discharge electrode 11, when the high voltage generator 12 is turned on. In the presently preferred embodiments, the voltage is in the order of 20-50 kV when the system is in use. The discharge electrode 11 is arranged inside the part of the flow passage 4 being delimited by the collection plate 5 so that a strong electric field is established in the flow passage 4 causing the flue gas around the discharge electrode 11 to become ionized. In the embodiment in FIG. 4, the high voltage generator 12 is arranged in the second compartment 7. The discharge electrode 11 is further connected to an insulator 13 arranged between the high voltage generator 12 and the discharge electrode 11. In the illustrated embodiment, this connection is made via a high voltage connector 14 which passes partly through the insulator 13 as shown in FIG. 1.*c*. When the discharge electrode 11 is of the type shown in further details in FIG. 7, see description below, the connection can be established by letting the discharge electrode connector 204 in the form of a tube slide over the high voltage connector 14. The rod-shaped high voltage connector 14 can then be fastened inside the discharge electrode connector 204 e.g. by screwing a screw through the discharge connector 204 that then reaches the high voltage connector 14 inside it. The insulator 13 is arranged between the discharge electrode 11 (negative polarity) and where the insulator 13 is mounted on the body of the ESP (grounded—positive polarity). It prevents the shortcut between two poles (i.e. the discharge electrode and the collection electrode). As shown schematically in FIG. 1.*c*, a high voltage cable 15 passes through the insulator 13 and connects to the high voltage connector 14, and the other end of this cable 15 is connected to the high voltage generator 12 as shown in FIG. 1.*b*.

The ionization of the flue gas releases electrons that charge the particles present in the flue gas. The charged particles are pushed toward the primary collection electrode in the form of the collection plate 5 and the secondary collection electrode in the form of the grid 101, together forming the collection electrode as described above, due to the same polarity electric field, and here they precipitate and stay until they are removed by the automatic cleaning or burning as described above. In known systems, this removal of particles from the collection electrode is e.g. done by use of a brush or by rapping as described above.

The grid 101 which is arranged in the part of the flow passage 4 delimited by the collection plate 5 comprises a mesh-like structure. In the illustrated embodiment, the grid 101 is in the form of a mesh e.g. made from wire-material, but it could also be a plate with holes. The mesh-like structure of the grid 101 is of an electrically conductive material, and the grid 101 is dimensioned, shaped and arranged such that it extends along and at a distance from the collection plate 5.

The particles are collected both on the grid 101 and on the collection plate 5, and as described above, this arrangement significantly improves the efficiency of the ESP compared to similar known systems without such a grid. Both the collection plate 5 and the grid 101 can be made from low or medium carbon steel; it can also be made from stainless steel or alloy steel to obtain a higher corrosion resistance.

FIG. 2 shows schematically an embodiment of a grid 101 wherein the mesh-like structure of the grid is in the form of a wire fence comprising openings 102 with a vertical and a horizontal dimension. By "vertical" and "horizontal" reference is made to the ESP system 1 when installed on a chimney; i.e. with the inlet 2 facing downwards and the outlet 3 is facing upwards. The vertical dimension of a grid 101 may be 15-30 mm, such as 18-25 mm, such as 20-22 mm, and the horizontal dimension may be 15-30 mm, such as 18-25 mm, such as 20-22 mm. Grids 101 having openings 102 of such dimensions have been tested during the development of the present invention, but other dimensions are also covered by the scope of the claims. The wire fence sheet has been cut to the size matching the inner dimensions of the collection plate 5 and installed with a clearance 103 inside the collection plate 5 as shown in FIG. 1. Hereby it is obtained that the grid 101 can move freely, i.e. without touching the collection plate, and when it slides up and down along the collection plate 5 in the embodiment described below. Thereby, it can detach the collected particles. This part of the cleaning due to the movement is in addition to the cleaning related to the burn-off of the particles as described above.

A characteristic of some embodiments of the present invention is a built-in possibility of regularly cleaning the grid 101 by removing the particles collected thereon in order to improve the efficiency of the ESP. This cleaning can be performed by the system itself so that a chimneysweeper does not need to have direct access in order to perform the cleaning e.g. by use of a brush as is of the case in known systems. Furthermore, with an ESP system 1 according to the present invention, the cleaning can be performed regularly, such as daily, and not just once or twice a year as is typically the case with traditional systems.

Figure 5:
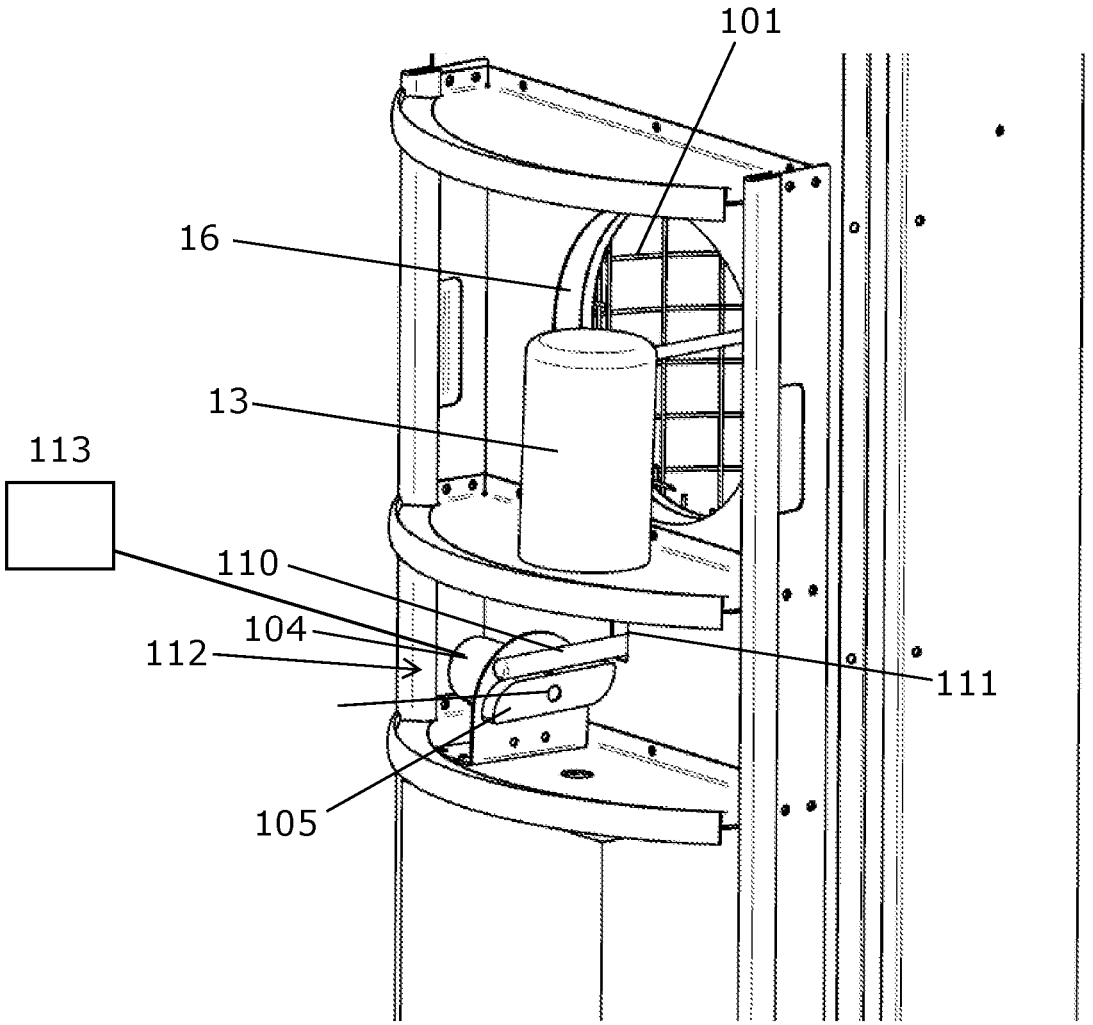
FIG. 5 shows schematically a part of a system according to an embodiment of the invention; the system comprising an actuator having a motor used to rotate a cam.
Figure 6:
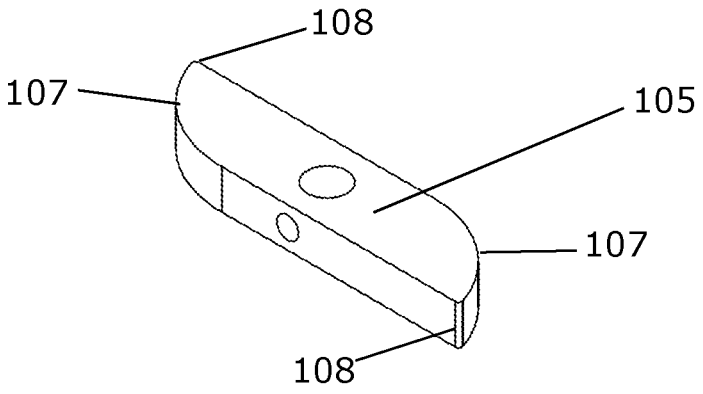
FIG. 6 shows schematically the cam of the actuator in FIG. 5.

In the illustrated embodiment, the cleaning of the collection electrode, in the form of the collection plate 5 and the grid 101, is established by an actuator 112 which can provide a force to the grid 101 so as to move the grid 101, when the actuator 112 is in operation. FIG. 5 shows schematically an example of such an actuator 112 comprising an electric motor 104 having an eccentric cam 105 mounted on a shaft 106 which can be rotated by the electric motor 104. The cam 105, when seen along the axis of rotation, has a shape that is generally rectangular with two rounded corners 107, the rounded corners 107 being opposite each other in both directions, such that the slope of the rounded corners 107 extends to a sharp edge 108; see FIG. 6. This shape with two sharp edges 108 has the effect of causing the grid 101 to drop as soon as the contacting means, see below, clear the sharp edge 108. This results in the most efficient accelerating effect due to gravity and thereby a high impact force when the grid 101 hits an internal bottom structure 109; see FIG. 4.

The grid 101 has a contacting means which extends from the grid 101. In the embodiment in FIGS. 1 and 2, the contacting means is a pin 110 arranged on the flat side surface of the grid 101 which pin 110 goes out through a slit 111 in the collection plate 5; see FIG. 5. In this embodiment of the invention, the electrical motor 104 with low rotational speed, such as below 100 rpm, causes the double-eccentric cam 105 to move the grid 101 upward. In tests performed with a prototype of the invention, the dimensions of the cam 105 were so that the upward movement of the grid 101 was about 25 mm. After being moved upwards, the grid 101 drops from this height due to gravity resulting in the grid 101 impacting on the internal bottom structure 109 of the ESP system 1. This internal bottom structure 109 is typically also a supporting base for the grid 101 when it is not being moved; i.e. when no cleaning due to impact is performed. In addition to the impacting action, cleaning is also established by friction between particles on the grid 101 and on the collection plate 5. The distance between the grid 101 and the collection plate 5 should preferably be chosen so that this friction is large enough to detach particles and low enough to allow the grid 101 to fall fast enough to impart the impact resulting in further removal of particles from the grid 101.

With the illustrated shape of the cam 105, every rotation of the motor 104 slides the grid 101 twice against the collection plate 5, and correspondingly the grid 101 falls on the internal bottom structure 109 twice. Every time the grid 101 hits the internal bottom structure 109, its impact helps to shake the particles off the grid 101.

The cleaning process can be activated in cold conditions, where no hot flue gas is present with the high voltage generator 12 shut off to prevent elutriation of the detached particles and prompt free fall of the particles, respectively. Alternatively, when the ESP is hot, where there is hot flue gas in the chimney with the high voltage generator 12 turned on to prevent the detached particles from leaving the ESP to the outside.

Embodiments of the ESP system 1 having an actuator 112 preferably further comprises a control system 113, which controls when the actuator 112 is in operation and for how long; i.e. that the actuator 112, when in operation, runs for a period of time during which the grid is moved a number of times.

Figure 7:
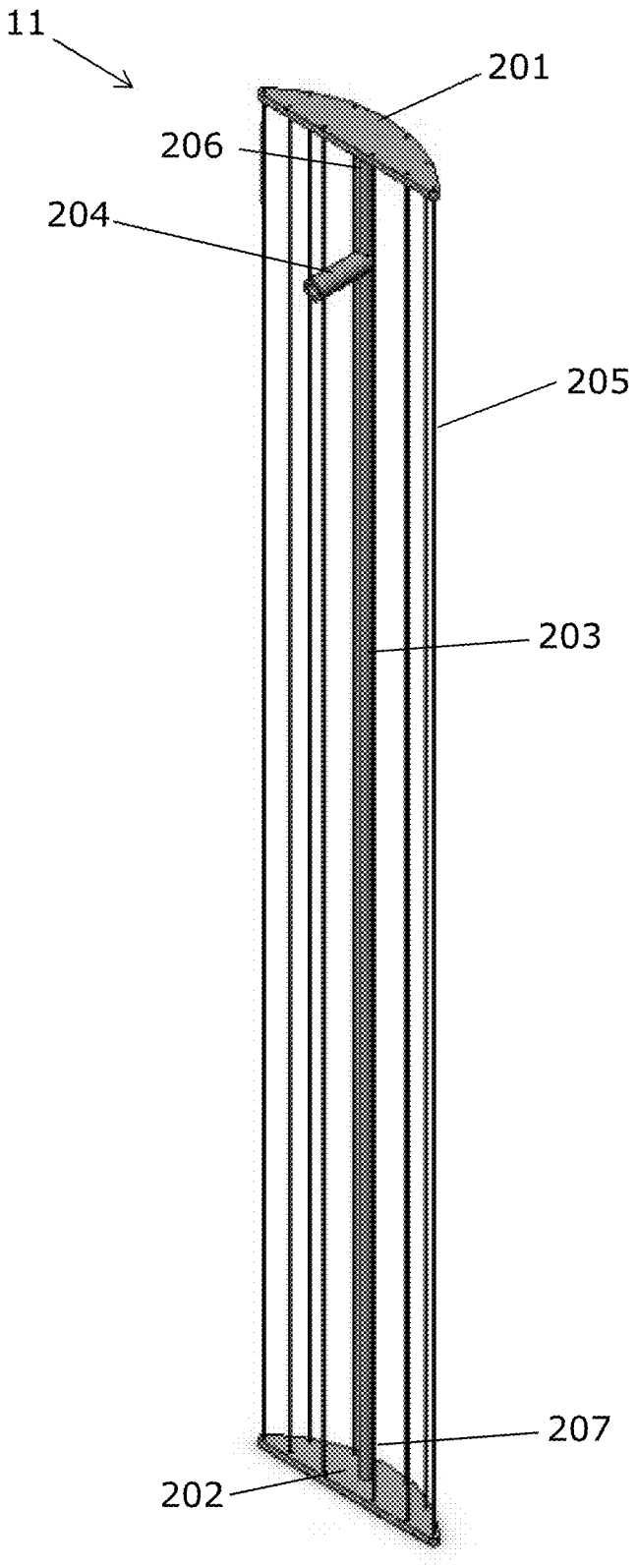
FIG. 7 shows schematically a discharge electrode of an embodiment of the invention.

FIG. 7 shows schematically an example of a discharge electrode 11 which may be used in an ESP system 1 as described above. Other types of discharge electrodes providing a suitable electrical field are also covered by the scope of the present invention. The discharge electrode 11 comprises a first wire connector 201 and a second wire connector 202, which are connected to and separated a distance apart by a support rod 203. The distance between the first and second wire connectors 201,202 may be 50 to 300 mm shorter than the vertical length of the collection plate 5, such as 100-200 mm shorter. A discharge electrode 11 wherein the distance between the first and second wire connectors 201,202 was of such a dimension has been tested during the development of the present invention, but other dimensions are also covered by the scope of the claims.

A discharge electrode connector 204 is attached to the support rod 203 of the discharge electrode 11 and located at a distance from the first and second wire connectors 201, 202. The optimum location of the discharge electrode connector 204 will depend on a number of parameters and possible further characteristics of the system in which the discharge electrode 11 is to be used.

In the embodiment shown in FIG. 7, the discharge electrode 11 has ten wires 205 suspended between the first and second wire connectors 201,202, but a discharge electrode 11 according to the invention may have more or less than ten wires 205 suspended between the two wire connectors 201,202. The wires 205 may have a characteristic width of 0.20-3.0 mm, such as 0.30-1.0 mm, such as 0.35-0.45 mm. Wires 205 having a diameter of 0.40 mm have been successfully used in the embodiment shown in FIG. 1, however, the optimum thickness of the wires 205 will depend on a number of parameters and possible further characteristics of the ESP system 1.

In the embodiment in FIG. 7, the first and second wire connectors 201,202 are disks each of which are shaped substantially as a circular segment. Furthermore, in the embodiment in FIG. 7, the first end 206 of the support rod 203 is mounted within a central region of the first wire connector 201 and a second end 207 of the support rod 203 is mounted within a central region of the second wire connector 202 with the wires 205 arranged around the support rod 203. In the illustrated embodiment, the wires 205 are situated at the edges of the first and second wire connectors 201,202 and distributed around the circumference of the disks with the wires 205 being substantially parallel to the support rod 203.

The discharge electrode connector 204, the first and second wire connectors 201,202, the support rod 203, and the wires 205 are all made of electrically conductive material. They may e.g. be made of corrosion-resistant material throughout or be made from another material having an outer coating of corrosion resistant material. They may also be made of different corrosion-resistant materials.

An ESP system 1 according to the present invention can e.g. be mounted on top of an existing chimney of a house, or it can be mounted to a chimney as part of the construction work when the house is being build. A grid 101 as described above, possibly movable by an actuator 112, can also be added to an existing ESP system 1 originally intended to be cleaned e.g. by use of a brush or other applied methods. The dimensions of the prototype tested during the development of the invention have been chosen for a small-scale system for use on private houses.

However, the scope of the claims are not limited to systems of this size; it also covers systems applicable for industrial large-scale use.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. In addition, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. An electrostatic precipitator system for dry particle precipitation comprising:

a flue gas inlet for receiving a flow of flue gas, a flue gas outlet for venting the flow of flue gas, a flow passage extending between the flue gas inlet and the flue gas outlet, part of the flow passage being delimited by a primary collection electrode in the form of a collection plate, a discharge electrode connected to a high voltage generator providing for an electric field being generated around the discharge electrode, when the high voltage generator is turned on, the discharge electrode being arranged inside the part of the flow passage being delimited by the collection plate, a secondary collection electrode in the form of a grid being arranged within the collection plate, the grid comprising a mesh-like structure, the mesh-like structure of the grid being made of an electrically conductive material, and the grid being dimensioned, shaped and configured such that it extends along and at a distance from the collection plate, and an actuator configured to provide a force to the grid so as to move the grid relative to the collection plate, when the actuator is in operation.

2. The electrostatic precipitator system according to claim 1, wherein the collection plate comprises a flat shape, which further extends into a curved shape to form a tubular cylinder segment.

3. The electrostatic precipitator system according to claim 1, wherein the grid comprises a corrosion-resistant material.

4. The electrostatic precipitator system according to claim 1, wherein the mesh-like structure of the grid comprises openings with a vertical dimension of 15-30 mm.

5. The electrostatic precipitator system according to claim 1, wherein the force provided by the actuator is an upwards force so as to move the grid upwards, so that the grid, after being moved upwards, drops from a height due to gravity resulting in the grid impacting on an internal bottom structure of the electrostatic precipitator system.

6. The electrostatic precipitator system according to claim 5, wherein the grid is resting on the internal bottom structure of the electrostatic precipitator system when not being moved upwards.

7. The electrostatic precipitator system according to claim 5, wherein the grid, when being moved upwards, is moved upwards a distance at least equal to, the vertical dimension of the openings in the grid.

8. The electrostatic precipitator system according to claim 1, further comprising a control system, which controls when the actuator is in operation and for how long, such that the actuator, when in operation, runs for a period of time during which the grid is moved a number of times.

9. The electrostatic precipitator system according to claim 1, wherein the electrical field generated by the discharge electrode is turned off, while the actuator is in operation.

10. The electrostatic precipitator system according to claim 1, wherein the grid comprises a contacting means which extends from the grid, the grid being moved upwards by the contacting means on the grid making contact with a cam being rotated by a motor, when the actuator is in operation.

11. The electrostatic precipitator system according to claim 10, wherein the cam, when seen along the axis of rotation, has a shape that is generally rectangular with two rounded corners, the rounded corners being opposite each other in both directions, such that the slope of the rounded corners extend to a sharp edge.

12. The electrostatic precipitator system according to claim 1, wherein the discharge electrode comprises:

a discharge electrode connector, which is connected to the high voltage generator, and a first and a second wire connectors, which are connected to and separated a distance apart by a support rod, the first and second wire connectors having at least one wire suspended between them, and wherein the discharge electrode connector, the first and second wire connectors, the support rod, and the at least one wire are all made of electrically conductive material.

13. The electrostatic precipitator system according to claim 12, wherein the discharge electrode comprises a plurality of wires, and wherein a first end of the support rod is mounted within a central region of the first wire connector, and a second end of the support rod is mounted within a central region of the second wire connector, such that the plurality of wires are arranged around the support rod.

14. The electrostatic precipitator system according to claim 12, wherein each of the first and second wire connectors is shaped as a disk and has a shape in the horizontal plane corresponding to that of a horizontal cross-section of the flow passage delimited by the collection plate when viewed in the vertical direction.

* * * * *